US006874339B2

(12) United States Patent
Segawa

(10) Patent No.: US 6,874,339 B2
(45) Date of Patent: Apr. 5, 2005

(54) EMERGENCY RELEASE SYSTEM FOR DOOR LOCK

(75) Inventor: Shiro Segawa, Kawasaki (JP)

(73) Assignee: Takigen Mfg. Co., Ltd., Tokyo (JP)

( * ) Notice: Subject to any disclaimer, the term of this patent is extended or adjusted under 35 U.S.C. 154(b) by 0 days.

(21) Appl. No.: 10/336,411

(22) Filed: Jan. 3, 2003

(65) Prior Publication Data

US 2003/0131639 A1 Jul. 17, 2003

(30) Foreign Application Priority Data

Jan. 8, 2002 (JP) ..... 2002-001850

(51) Int. Cl.[7] ..... E05B 65/10
(52) U.S. Cl. ..... 70/92; 70/465
(58) Field of Search ..... 70/92, 465, DIG. 48, 70/99, 100, 104, 106, 432; 292/DIG. 65; 49/31

(56) References Cited

U.S. PATENT DOCUMENTS 1,986,125 A * 1/1935 Teichmann ..... 70/299
3,738,681 A * 6/1973 Wada et al. ..... 280/728.1
4,230,352 A * 10/1980 Sealey et al. ..... 292/341.17
4,480,451 A * 11/1984 Fujiya ..... 70/92
4,522,359 A * 6/1985 Church et al. ..... 244/129.5
4,714,282 A * 12/1987 Henderson ..... 292/36
4,717,909 A * 1/1988 Davis ..... 340/686.4
5,116,089 A * 5/1992 Taylor ..... 292/78
5,201,556 A * 4/1993 Kendall ..... 292/257
5,590,917 A * 1/1997 Brooks et al. ..... 292/21

FOREIGN PATENT DOCUMENTS

JP 11-256896 9/1999 ..... E05B/37/16

* cited by examiner

*Primary Examiner*—John B. Walsh
(74) *Attorney, Agent, or Firm*—Darby & Darby

(57) ABSTRACT

An emergency release for a door lock that is to be mounted to a door includes a lock unit having handles and a lock, one of the handles being associated with the lock and the other not associated therewith, a latch unit having a latching bolt, wherein the lock, when set, prevents retraction of the latching bolt by rotation of the handle associated with the lock, but does not prevent the retraction by rotation of the other handle, a linking unit having latch retraction means and a holding element, and a sensor unit having a sensor door. The sensor door is opened in response to a predetermined pressure change across the door on which the door lock is mounted and is connected to the holding element so that the holding element actuates latch retraction when the sensor door is opened for retracting the bolt independently of the lock unit.

8 Claims, 16 Drawing Sheets

EMERGENCY RELEASE SYSTEM FOR DOOR LOCK

FIELD OF ART

The present invention relates to emergency release systems for door lock, in particular emergency lock release systems for doors having a lock, which automatically unlatch the door to open in case of emergency in a manner independent from a normal releasing operation of the lock.

BACKGROUND ART

Doors are used for partitioning spaces, such as inside and outside of buildings, rooms in a building, a control cabin and a passenger cabin in airplanes, and hotel rooms. Such doors are often provided with locks for the purpose of protection of privacy or security.

Some types of the doors with locks for protecting rooms are openable by simply rotating a handle or knob on the doors from inside the room, but requires releasing of the locks for opening from outside the rooms for security. Some types of the locks are released by using keys or magnetic cards, and some other types are released by pressing buttons or turning a dial in predetermined directions, in accordance with a predetermined secrete code, which the opener of the door must memorize. When the lock is released in such a way, the door is openable by rotating and pulling or pushing the handle or knob.

Recently, push button locks are often used, in particular for the door between the passenger cabin and the control cabin of jet airplanes for security. In some cases, the secrete code for releasing the lock is changed even for each flight for preventing unauthorized opening of the door. Such push button locks are disclosed, for example, in JP-58-80074 and JP-11-256896, the latter being an improvement of the former.

When the door is locked with such a lock, the door cannot be opened from the passenger cabin side without releasing the lock. For example, in case an intentional explosion occurs in the passenger cabin of a jet airplane and the air pressure in the passenger cabin is suddenly increased, if the door and the door frame partitioning the passenger and control cabins are firmer than the explosive power, the windows, doors, or even a part of the fuselage on the passenger cabin side may be destroyed. Then the air pressure in the passenger cabin is suddenly lowered due to exposure to the surrounding atmosphere, which endangers the passengers.

Further, in case the windows on the control cabin side are damaged, and the air pressure in the control cabin suddenly decreases, the door between the control and passenger cabins may be destroyed, and hit the instruments and gauges or the pilots, causing loss of flight controls.

When an explosion happens in an hermetically-sealed room, the door of the room may be destroyed, and not only the room itself but also the entire house or building may also be destroyed, resulting in serious human damage.

SUMMARY OF THE INVENTION

It is therefore an object of the present invention to provide an emergency release system for door lock which automatically opens a locked door when a pressure difference occurs across the door due to explosion, destruction of windows, or the like, for immediately balancing the pressure across the door in order to prevent damage on people or instruments in the cabin.

It is another object of the present invention to provide an emergency release system for door lock which prevents destruction of a door or a lock in emergency to improve their durability, even when there is no time to open the locked door by releasing the lock or rotating a door knob.

It is still another object of the present invention to provide an emergency release system for door lock which improves a door lock release system of a type that is openable in a normal state by releasing the door lock and rotating a door knob from outside the room, or by simply rotating a door knob from inside the room, and which enables immediate opening of a locked door in case of emergency such as explosion or destruction of windows on either side of the door.

According to the present invention, there is provided an emergency release system for door lock comprising:

a lock unit provided on a door and having a handle on each side of said door and a lock, said handle on one side of the door being associated with said lock, while said handle on the other side of the door is not associated with said lock, a latch unit having a latching bolt projectable from the door for latching the door, and retractable into the door for unlatching the door, wherein said lock, when set, prevents retraction of said latching bolt by means of rotation of said handle on said one side of the door for unlatching the door, but does not prevent retraction of said latching bolt by means of rotation of said handle on said other side of the door, a linking unit having latch retraction means connected with respect to said latching unit, and holding means releasably holding said latch retraction means in a rest position, and a sensor door unit provided in said door and having sensor door means, wherein said sensor door means is automatically openable by means of a pressure difference across said door above a predetermined threshold level, and is connected to said holding means so that said holding means releases and allows actuation of said latch retraction means when said sensor door means is opened, for retracting said latching bolt to allow automatic opening of the door independently from said lock unit.

The emergency release system for door lock according to the present invention may be installed on any type of a door, such as a double leaf or single leaf door. But the present invention is usually installed on a single leaf door of either right handed or left handed type. The door may be those for partitioning inside and outside of a building, partitioning rooms in a building, partitioning cabins of a transportation vehicle such as airplanes, automobiles, and ships. The present invention may be installed in particular on a door for partitioning the control cabin and the passenger cabin of an airplane.

The lock unit may include any type of a lock, as long as the lock, when released, allows retraction of the latching bolt by rotation of a handle or knob on either side of the door for opening the door, but when set, allows the retraction by rotation of the handle on only one of the sides of the door, and prevents the retraction by rotation of the handle on the other side of the door. For opening the door from the other side of the door, the lock must be released for retracting the latching bolt. For example, the lock may be a push button lock having lock pins, dial lock openable by rotation of the dial, magnetic lock openable with a magnetic card, or cylinder lock openable with a key.

The latching bolt may be, for example, a latch having a tapered end, a dead bolt in the form of a columnar or prismatic bar without a tapered end, or a cremone bolt.

The lock unit may further include a release cam actuated by means of the handles, and the latch unit further includes a latch engagement member connected to the latching bolt, a sliding frame connected to the latching bolt, a bracing frame stationary with respect to the sliding frame, and a spring. The latching bolt may penetrate the sliding frame and the bracing frame, and the spring may be positioned around the latching bolt between the sliding frame and the bracing frame for urging the sliding frame and the latching bolt in a latching direction. The latch engagement member and the release cam may cooperate to retract the latching bolt to unlatch the door against the force of the spring, when either of the handles is rotated.

With this structure, the latching bolt may be constantly urged into its latching position for keeping the door latched, and retractable into the door against the force of the spring when either of the handles is rotated, by the cooperation of the release cam and the latch engagement member, allowing the door to open.

The sensor door means is designed to open automatically when a pressure difference above a predetermined threshold level occurs across the door. For example, the sensor door means may be designed to open at a small pressure difference, such as 7 g/cm$^2$ or more.

The sensor door unit may further include a plurality of through holes provided in the door, and the sensor door means may have a concave. The through holes may preferably be positioned facing to the concave, more preferably uniformly dispersed. The concave of the sensor door means facilitates collection of the air flow received from the higher pressure side of the door through the through holes, and improves sensitivity of the sensor door means for the pressure difference. The size, number, and arrangement of the through holes in the door may suitably be selected for desired sensitivity of the sensor door means.

The latch retraction means may include a cam releasably held by the holding means, and a linking member engaging the cam and connected to the latching bolt. When the sensor door means is opened, the holding means may release the cam for allowing rotation of the cam to move the linking member, and the linking member in turn moves the latching bolt in a unlatching direction, thereby allowing the door to open.

In this embodiment, the latching bolt may be slidably connected to the linking member, and have engagement means for engaging the linking member so as to be moved by the linking member in an unlatching direction when the linking member is moved by the cam.

With this structure, the latching bolt may be moved independent from the linking unit and the sensor door unit in a normal state. But in case of emergency, the latching bolt may securely engage the linking member for effective transmission of the force applied by the cam to unlatch the door immediately.

According to another aspect, the latching bolt may be slidably connected to the latch retraction means. When the latching bolt is retracted by means of one of the handles, the latching bolt may slide with respect to the latch retraction means, with the latch retraction means remaining in its rest position.

With this structure, in a normal state, the door may be unlatched to open by rotating one of the handles, independent from the linking unit and the sensor door unit.

The emergency release system for door lock of the present invention may preferably be composed only of mechanical systems, and may not require any electrical systems. This eliminates adverse effect of the electrical systems on the instruments and gauges of the vehicle on which the system is installed, and risk of possible ignition of gases or oils in the vehicle.

The latch unit, linking unit, and sensor door unit of the emergency release system for door lock of the present invention may preferably be arranged linearly. With this arrangement, the latching bolt may be operated conveniently and securely, without undesired protrusions formed on the door surface.

BRIEF DESCRIPTION OF THE DRAWINGS

A preferred embodiment of the present invention will now be explained in further detail with reference to attached drawings, in which.

PREFERRED EMBODIMENTS OF THE INVENTION

Figure 1:
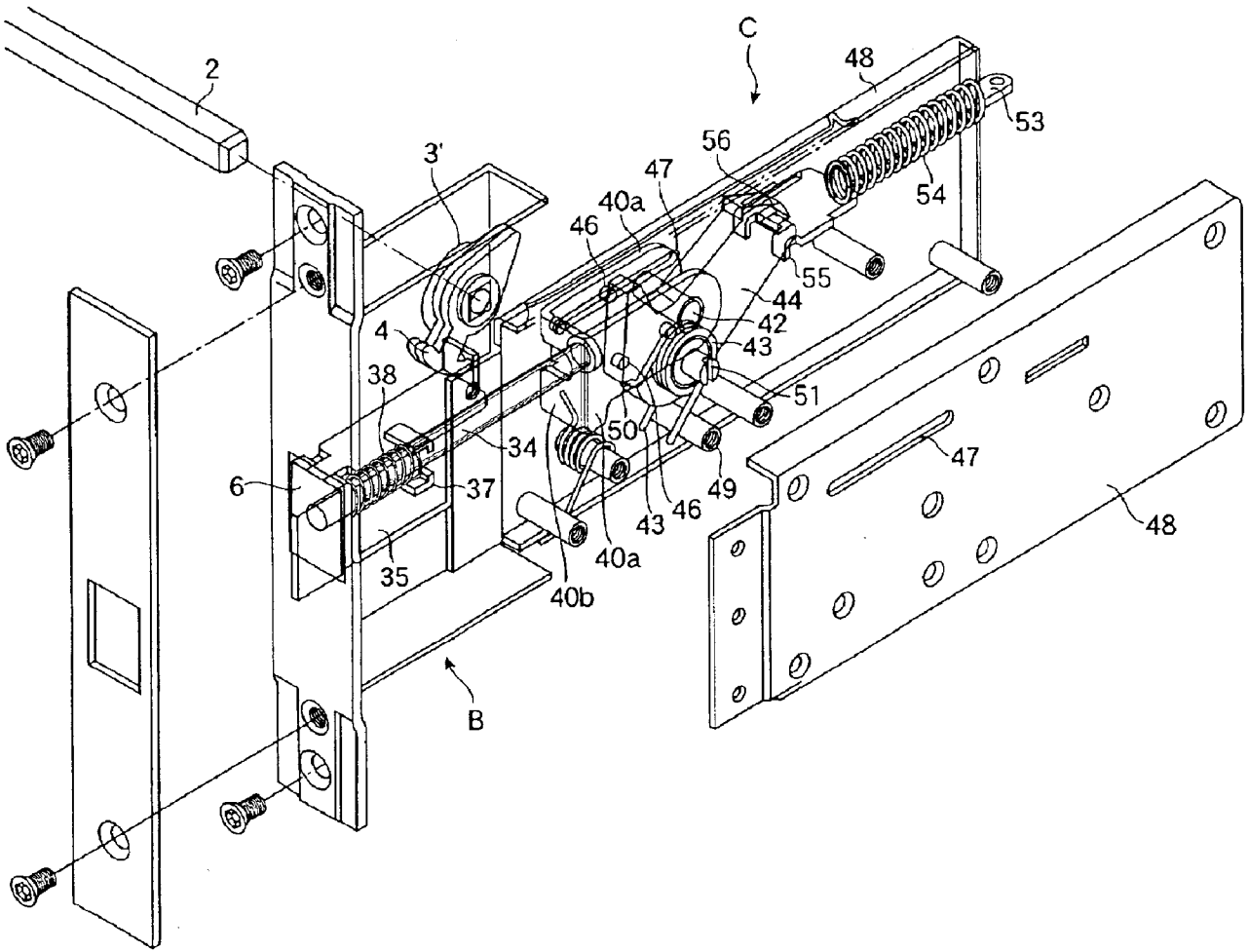
FIG. 1 is an exploded perspective view of latch unit B and linking unit C of the emergency release system for door lock, showing a part of the characteristic features of the present invention.

The present invention will now be explained with reference to a preferred embodiment, which is illustrative only and does not intend to limit the present invention.

FIGS. 2 to 6 show an embodiment of the emergency release system for door lock of the present invention. In this embodiment, the emergency release system is installed in a door 7 of a control cabin of an air plane. The door 7 is pivotally provided in a door frame 8 by means of hinges 10, and latched with latch 6 retractably inserted in hole 9 in the frame 8.

The emergency release system for door lock of the present invention includes lock unit A and latch unit B, which constitute a door lock release system, and linking unit C and sensor door unit D.

The lock unit A is shown in detail in FIGS. 7 to 16. The lock unit A has lock (a), which is shown and explained as a push button lock in this embodiment, main handle knob 1 on the passenger cabin side, and auxiliary handle knob 5 on the control cabin side. The main handle knob 1 is integrally connected to rectangular pin 2, to which locking cam 3 and release cam 4 are also integrally connected. Rotation of the knob 1 around the pin 2 in clockwise or counterclockwise results in simultaneous rotation of the locking cam 3 and the release cam 4 around the pin 2, which causes retraction of the latch 6 into the door 7 out of the hole 9, allowing the door 7 to open in the way to be discussed later. The auxiliary handle knob 5, located on the opposite side of the door 7, is provided independently from the main knob 1 and the lock (a). That is, rotation of the auxiliary knob 5 will not cause rotation of the main knob 1 and release of the lock (a), but simply rotate the release cam 4 to cause retraction of the latch 6. In this way, the main knob 1 is associated with the lock (a), but the auxiliary knob 5 is not associated with the lock (a)

The lock (a) in the form of a push button lock has casing 24 and twelve push buttons 12 disposed in corresponding holes in the casing 24 arranged in two lines of six holes each. Inside the casing 24 is locking plate 11, which rests on the cam 3, and is vertically slidable by the action of the cam 3. The locking plate 11 has twelve holes 14 arranged in two lines of six holes each. In each hole 14 is located shaft 13, which is capped with the corresponding button 12. Each shaft 13 has in its inner end portion upper notch 16 and lower notch 15. The upper and lower notches 15 and 16 are offset in the axial direction of the shaft, i.e., the direction of pressing of the button 12, with the upper notch 16 closer to the front side, and angularly displaced from each other by 180 degrees. Spring 22 is provided between each button 12 and the corresponding shaft 13 for urging the button 12 outwards.

Each shaft 13 has a tapered positioning plate 17 of an umbrella-like shape provided on the side of the shaft 13 opposite to the end capped with the button 12. The positioning plate 17 has a surface tapered toward the rear side of the lock unit A, and a smaller diameter portion. Positioning spring 19 is suspended from above each positioning plate 17, and attached to reset plate 20 located on the rear side of the locking plate 11. The reset plate 20 is urged downward by spring 21 located on its upper surface, so that the positioning springs 19 are kept in contact with the positioning plate 17. The reset plate 20 has a surface that is in engagement of reset button 18, and when the reset button 18 is pressed, the reset plate 20 slides upward, so that the positioning springs 19 are out of contact with the positioning plates 17. The reset plate 20 rests on the cam 3, and is vertically slidable against the force of the spring 21 by the action of the cam 3.

When the button 12 is pressed down and the pressing force is released, the button 12 immediately returns to is initial position by the action of the spring 22, and the shaft 13 remains in the pressed position, since the positioning spring 19 moves along the tapered surface of the positioning plate 17 into contact with its smaller diameter portion to maintain the shaft 13 in the pressed position.

Stopper plate 23 is connected to the casing 24, and is positioned on the rear side of the reset plate 20 to limit the stroke of the shaft 13 at a predetermined depth by contacting with the rear surface of the tapered positioning plates 17. Stopper bar 28 is integrally provided on the rear surface of each positioning plate 17, and positioned through the corresponding hole in the stopper plate 23.

On the rear side of the stopper plate 23 are provided cylinders 25. In each cylinder 25, piston 27 having piston rod 29 and spring 26 urging the piston 27 toward the shaft 13 are located. The piston rod 29 extends out of the cylinder 25, and is provided with knob 30 fixed on its free end.

The knobs 30 are arranged on the rear surface of the lock unit A, i.e. on the control cabin side, and are turnable to rotate the shaft 13 for changing the angular orientation of the notches 15 and 16 of the shaft 13 for setting the notches 15 and 16 in accordance with a secrete code for releasing the lock (a). Each knob 30 has a notched pointer for indicating which button must be pushed according to the security code for releasing the lock (a). For example, for buttons 12 that must not be pressed down for unlocking, corresponding knobs 30 are oriented with their pointer pointing up 31*a*, whereas for buttons 12 that must be pressed down for unlocking, corresponding knobs 30 are turned for 180 degrees to be oriented with their pointer pointing down 31*b*.

The operation of the lock unit A discussed above for locking and unlocking the door 7 with the latch 6 are explained below.

Figure 8:
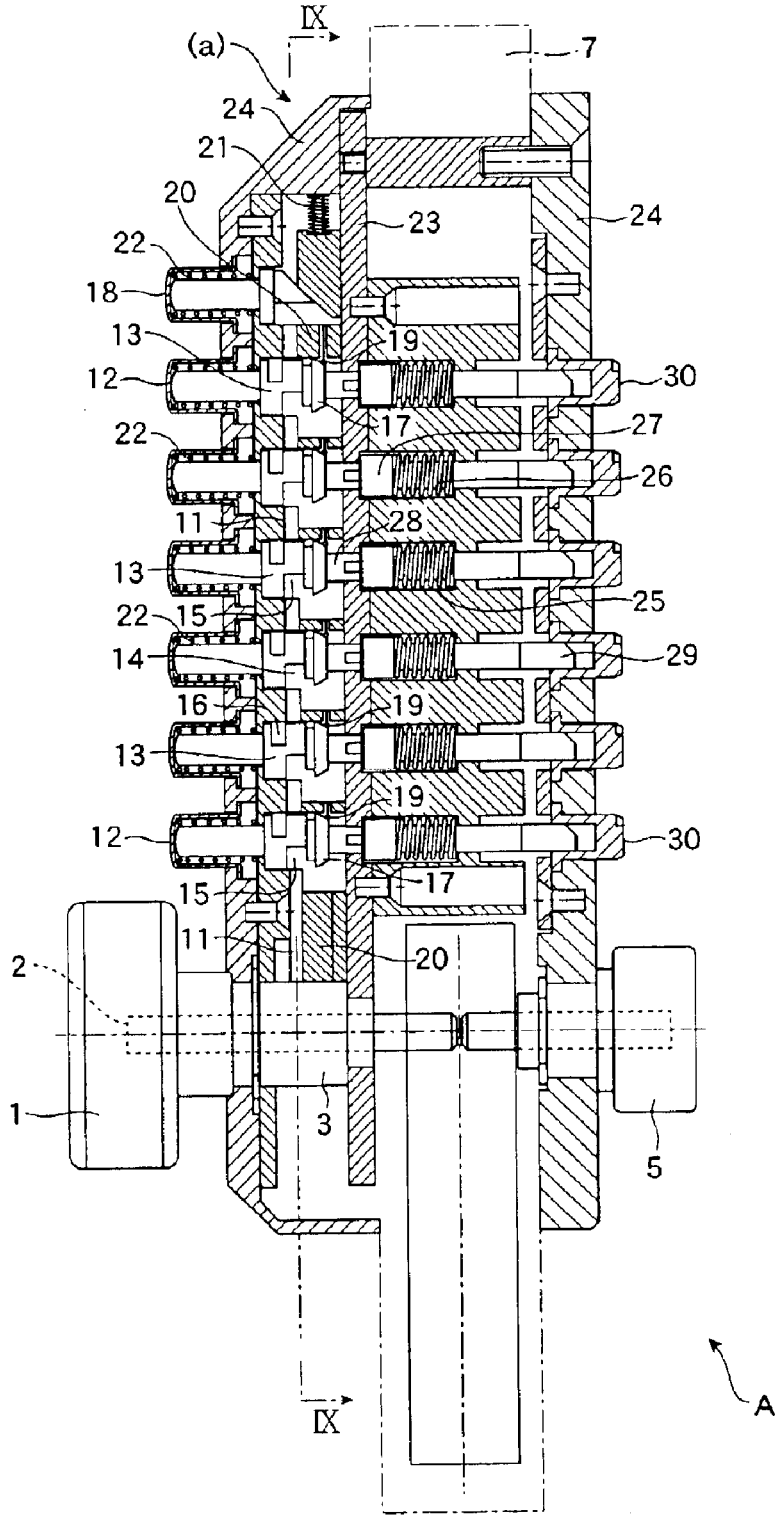
FIG. 8 is a vertical sectional view of lock unit A in the unlocked state, with the handle knobs not rotated.
Figure 9:
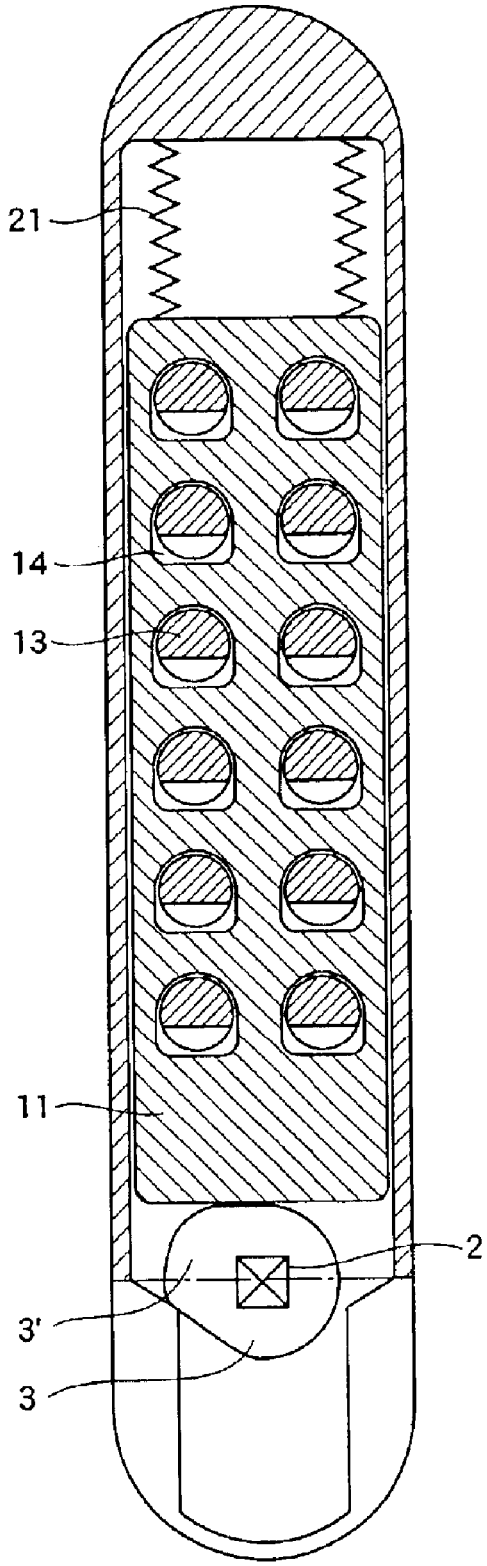
FIG. 9 is a sectional view taken along lines IX—IX in FIG. 8, with some parts removed for clarity.
Figure 10:
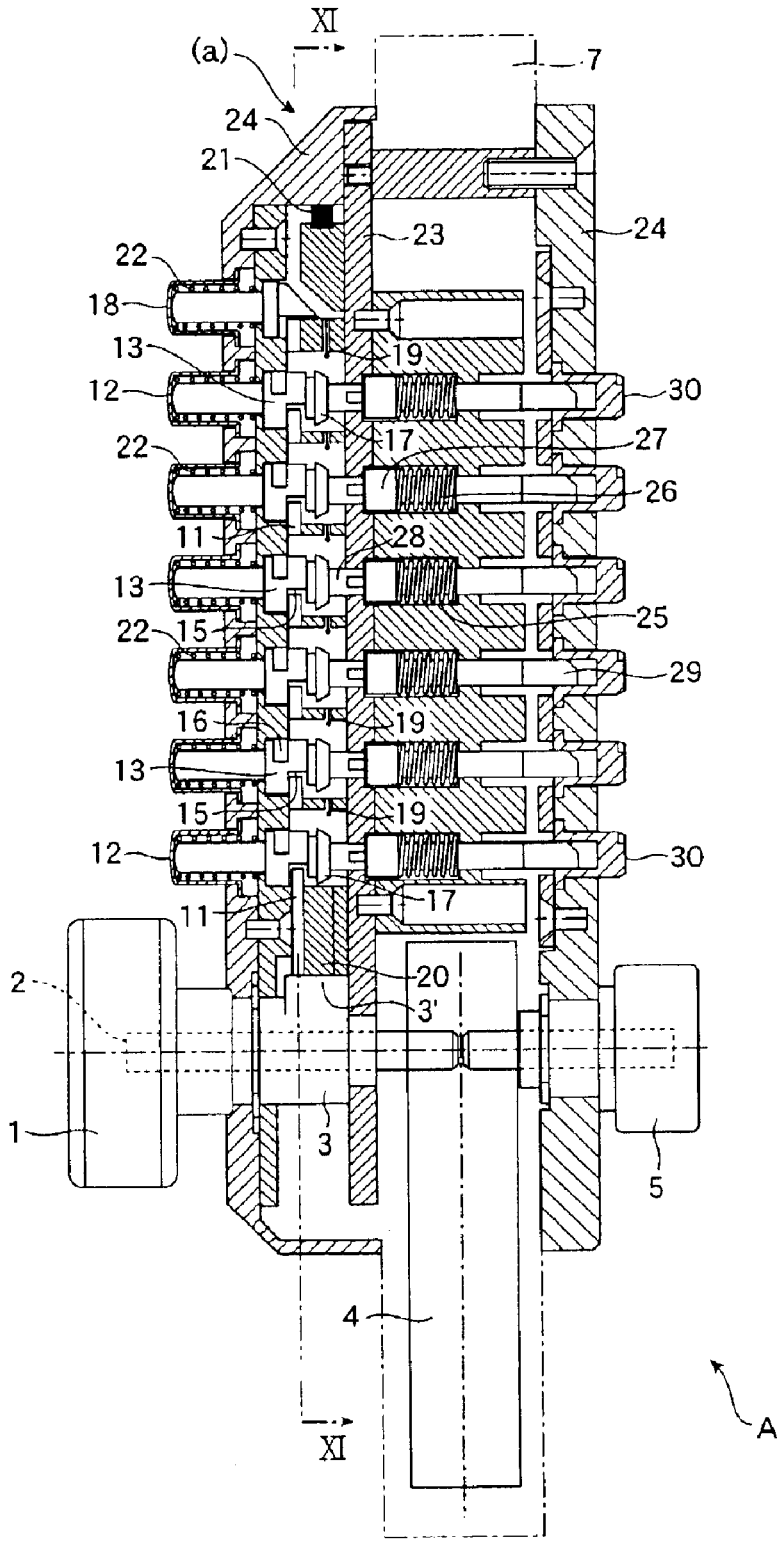
FIG. 10 is a vertical sectional view of lock unit A in the unlocked state, with the handle knobs rotated.
Figure 11:
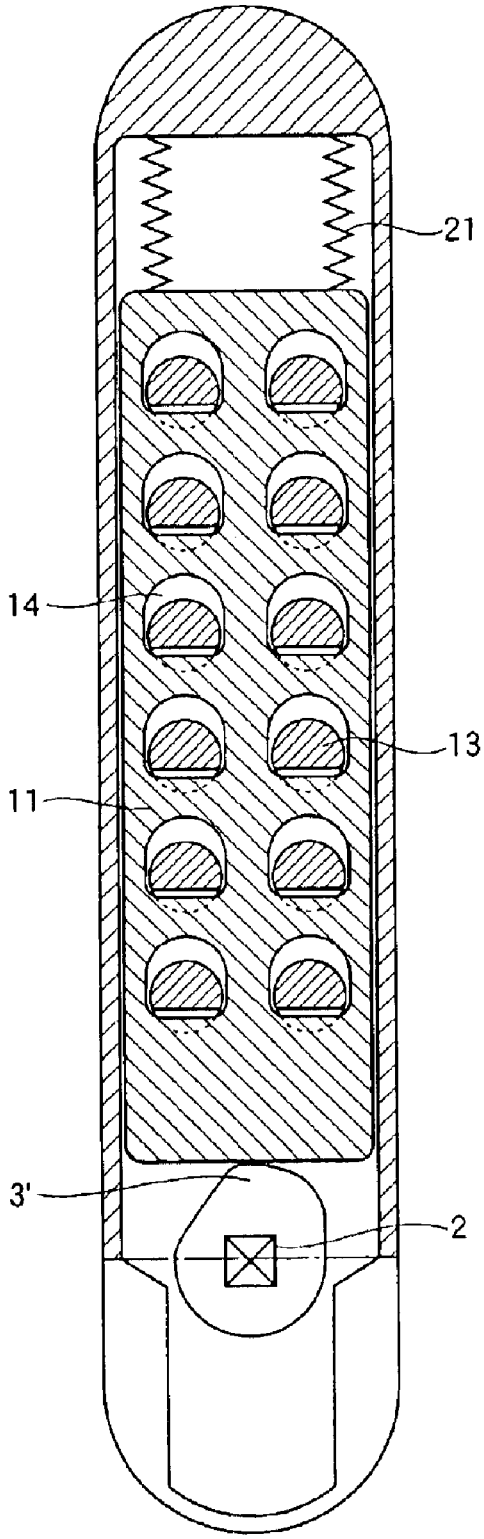
FIG. 11 is a sectional view taken along lines XI—XI in FIG. 10, with some parts removed for clarity.

FIGS. 8 to 11 show the lock unit A in its released state wherein no secret code is set. In the initial state shown in FIGS. 8 and 9, the lower notches 15 of all the shafts 13 are aligned with the locking plate 11. In this position, when the main knob 1 is rotated clockwise or counterclockwise, the cam 3 is allowed to rotate and push the locking plate 11 and the reset plate 20 upward by cam portion 3', since the locking plate 11 is allowed to enter the lower notches 15 as shown in FIGS. 10 and 11. Thus the main knob 1 is not prevented by the shafts 13 from being rotated, and accordingly, the release cam 4 is rotated with the main knob 1 from the locking position shown in FIG. 2 into the unlocking position shown in FIG. 4 to thereby draw the latch 6 of the latch unit B out of the hole 9 in the door frame 8 to unlatch the door 7.

Figure 12:
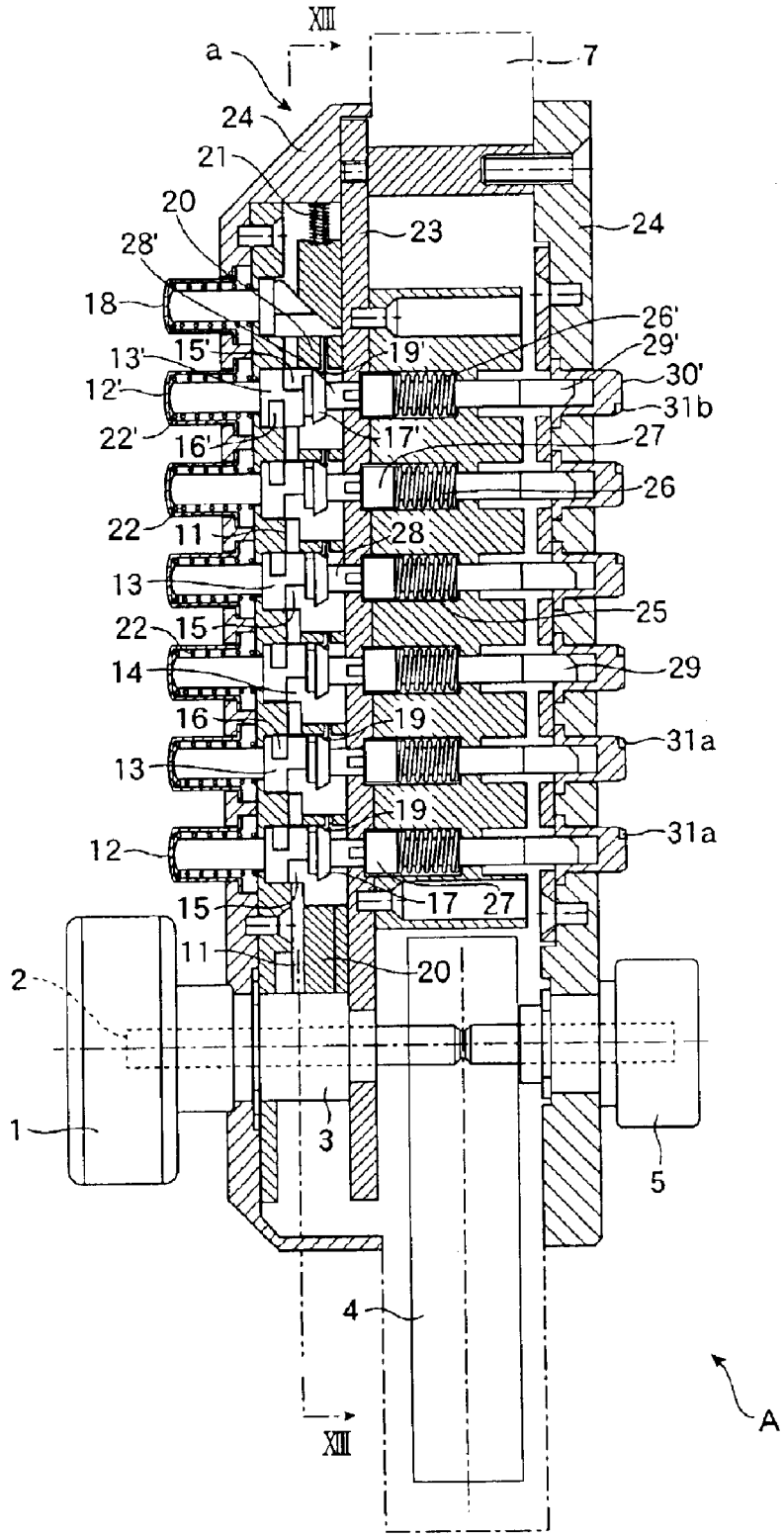
FIG. 12 is a vertical sectional view of lock unit A, with the knob corresponding to the top button in the right line turned for 180 degrees to set a secrete code for releasing the lock.
Figure 13:
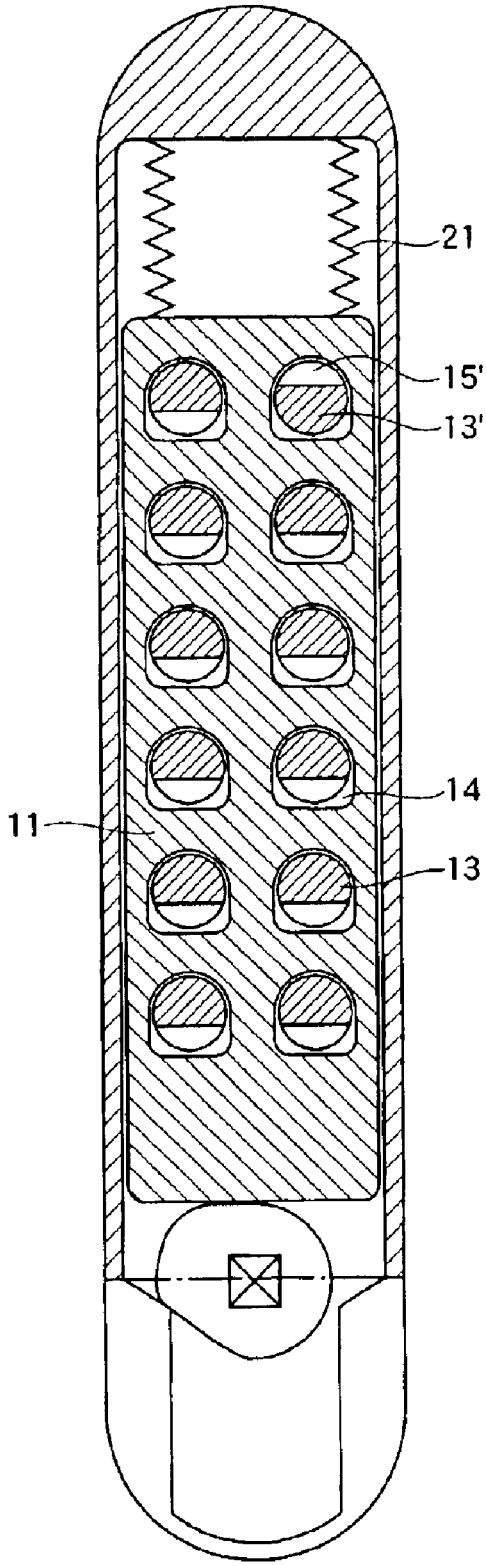
FIG. 13 is a sectional view taken along lines XIII—XIII in FIG. 12, with some parts removed for clarity.

Next, a secrete code for release is set on the lock unit A. For example, when the top button 12' in the right line is selected as a secrete code, the corresponding knob 30' is turned for 180 degrees so that the pointer points downward 31*b* as shown in FIGS. 12 and 13. This makes the corresponding shaft 13' to also rotate for 180 degrees into the position where the lower notch 15 is opened upward. All the other knobs 30 remain in the position with the pointer pointing upward 31*a*. In this state shown in FIGS. 12 and 13, when a rotational torque is applied to the main knob 1, the cam 3 tries to rotate and push up the locking plate 11 as mentioned above. In this case, however, since all the lower notches 15 are not in alignment with the locking plate 11, the plate 11 hits the shaft 13' and is not allowed to move upward. Thus, the cam 3 and accordingly the main knob 1 is not allowed to rotate, and the lock unit A is set.

Figure 14:
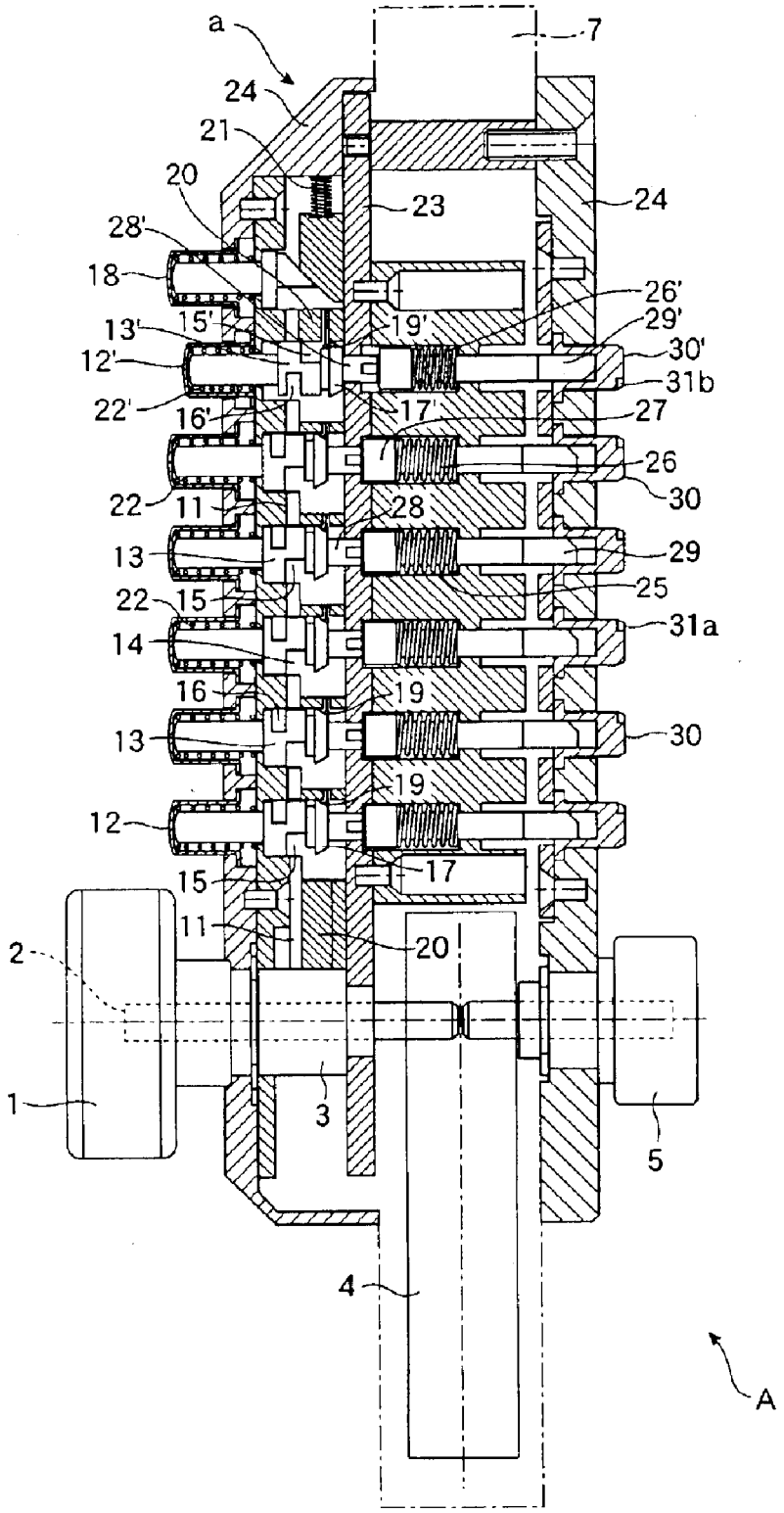
FIG. 14 is a vertical sectional view of lock unit A shown in FIG. 12, with the button corresponding to the secrete code pressed down.

For opening the door 7 by rotating the main knob 1 from this state, only the top button 12' in the right line is pressed down as shown in FIG. 14 according to the secrete code as set, to move the corresponding shaft 13' and positioning plate 17' rearward until the positioning plate 17' abuts the stopper plate 23. Here, the positioning spring 19' that was in contact with the tapered surface of the positioning plate 17', is moved along the tapered surface beyond the largest diameter portion into the smaller diameter portion, and keeps the positioning plate 17' and thus the shaft 13' in the pressed position against the force of the corresponding spring 26'. Since the button 12' is returned to its initial position by the force of the spring 22' as shown in FIG. 17, it is not possible to tell by appearance which button has been pressed and which has not, which effectively prevents cryptanalysis of the secrete code.

Figure 15:
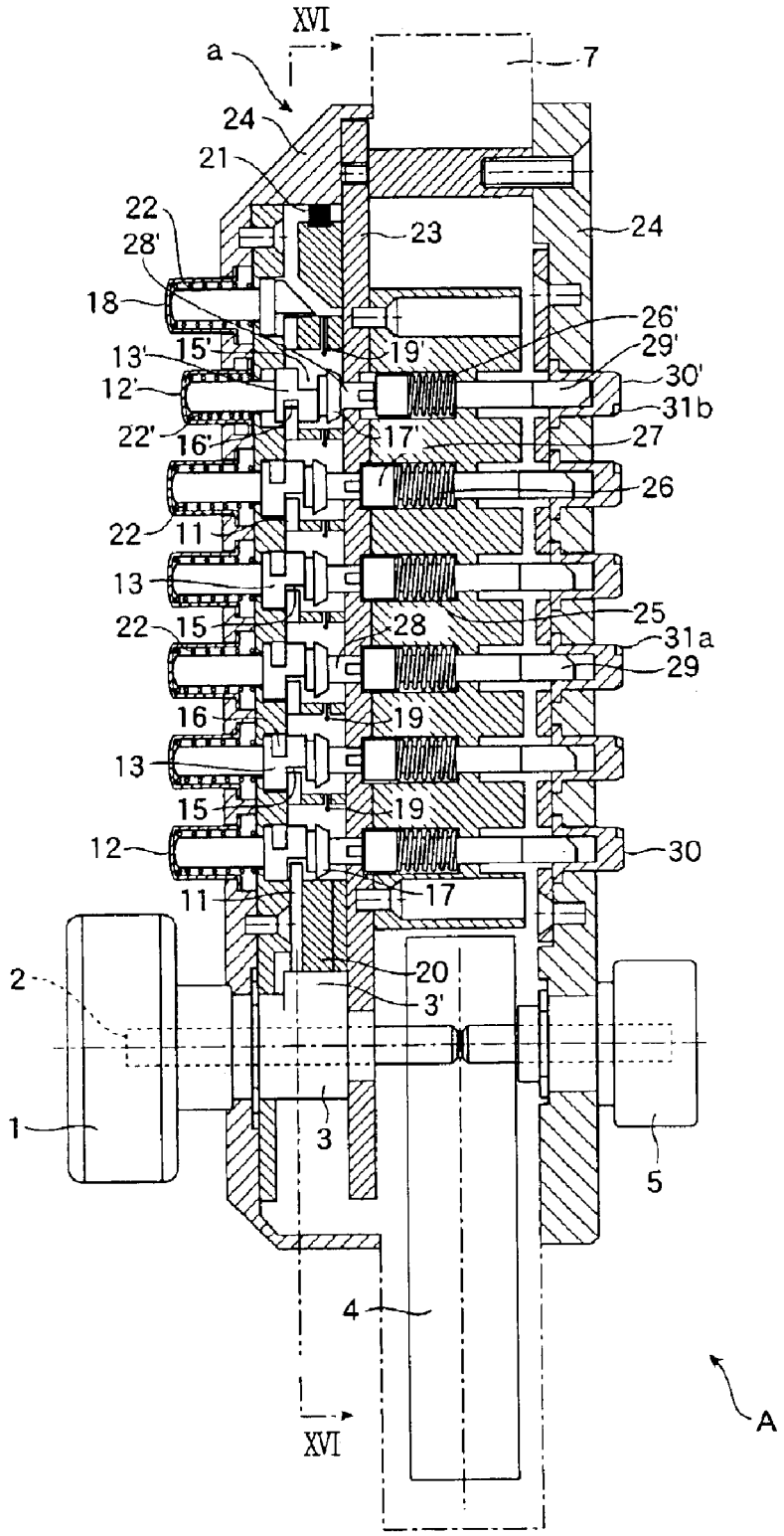
FIG. 15 is a vertical sectional view of lock unit A shown in FIG. 14, with the knob rotated for unlatching.

In the state shown in FIG. 14, the lower notch 15' of the shaft 13' is oriented upward, but instead, the upper notch 16' is now oriented downward and aligned with the locking plate 11. Thus, when the main knob 1 is rotated, the cam 3 is allowed to rotate and push the locking plate 11 and the reset plate 20 upward by the cam portion 3', since the locking plate 11 is allowed to enter the upper notch 16' now opened downward and other lower notches 15 as shown in FIG. 15. Thus the release cam 4 is allowed to rotate with the main knob 1 from the locking position into the unlocking position to thereby draw the latch 6 out of the hole 9 to unlatch the door 7.

Figure 17:
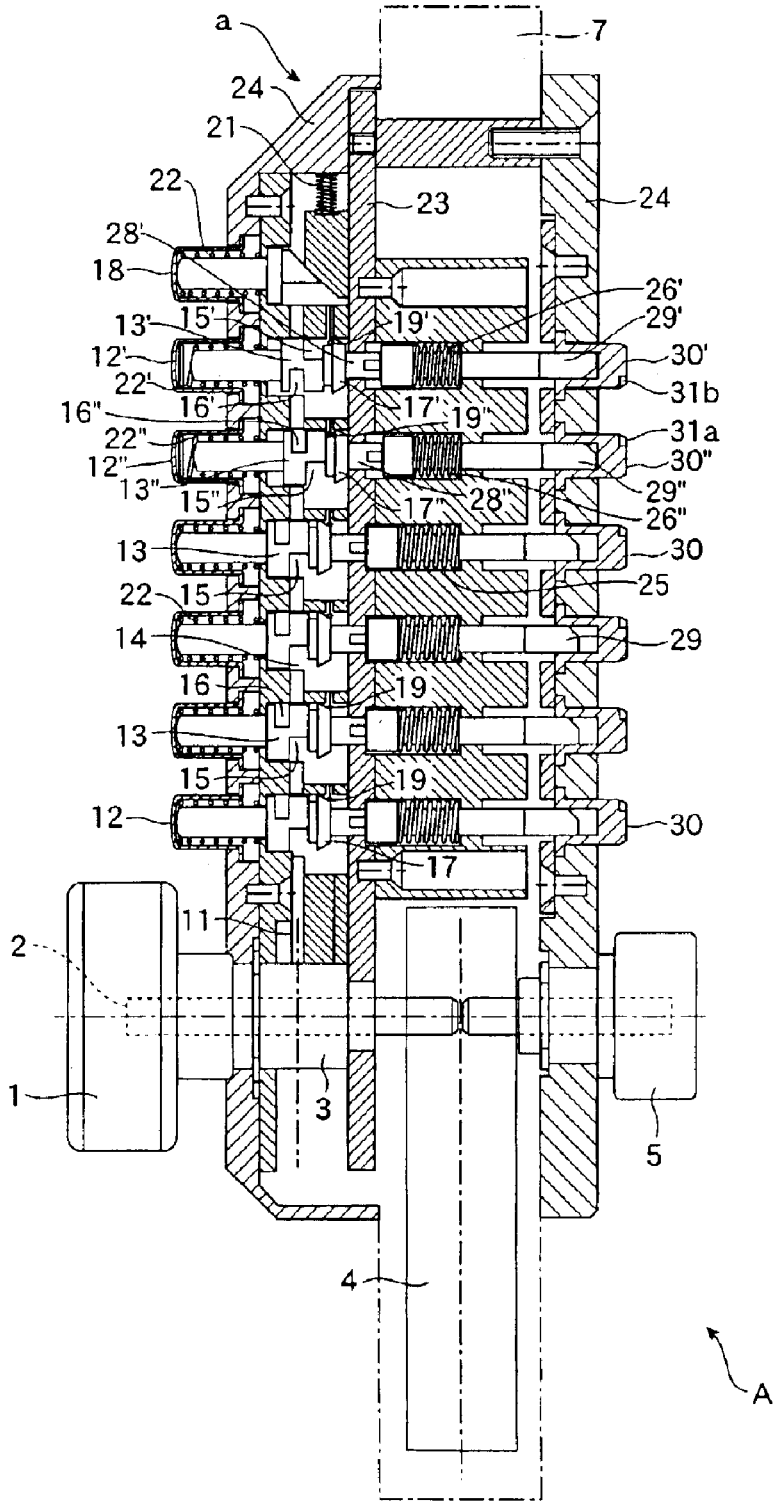
FIG. 17 is a vertical sectional view of lock unit A shown in FIG. 14, with the second button from the top in the right line also pressed down, which does not correspond to the secrete code.
Figure 18:
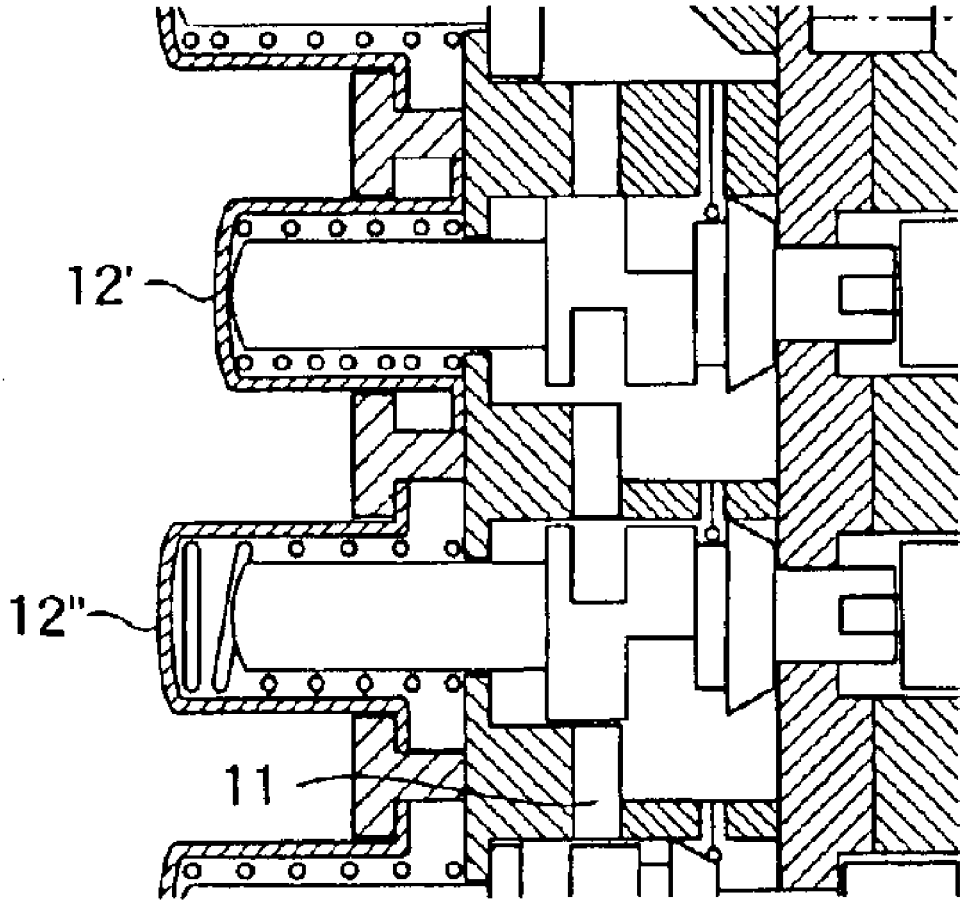
FIG. 18 is an enlarged view of a part of lock unit A of FIGS. 8 to 17.

FIG. 17 shows the state where the top button 12' is selected as a secrete code as above, but a non-selected second button 12" from the top in the right line is also pressed in addition to the selected button 12'. Here, the corresponding second shaft 13" is moved rearward, and the corresponding lower notch 15" is moved out of the alignment with the locking plate 11. Thus when a rotational torque is applied to the main knob 1, the plate 11 hits the shaft 13" and is not allowed to move upward, preventing the main knob 1 from being rotated. In this way, once a non-selected button 12" is pressed, the lock unit A is locked, and the main knob 1 cannot be rotated.

It may happen that a non-selected button 12" is pressed by error. In that case, the reset button 18 is pressed to move the reset plate 20 upward against the force of the spring 21 to lift up the corresponding positioning spring 19". Disengagement of the positioning spring 19" from the positioning plate 17" allows the corresponding piston 27", stopper bar 28", positioning plate 17", and the shaft 13" to move frontward by the force of the spring 26", so that the lower notch 15" is returned to its initial position and the positioning spring 19" contacts the tapered surface of the positioning plate 17".

Next, the latch unit B is explained with reference to FIGS. 1, 2, 4, and 5. The latch unit B includes the latch 6 that is able to projected from the door and inserted into the hole 9 in the door frame for latching the door 7, and is able to be retracted into the door 7 from the hole 9 for unlatching the door 7. The latch unit B also includes a latch engagement member 32 connected integrally to the latch 6 and engageable with the release cam 4 of the lock unit A for moving the latch 6 in the unlatching direction. The latch 6 and the latch engagement member 32 are conventional components of a latch unit. The present latch unit B further includes linking bar 34 integrally fixed to the latch 6 on one end with pin 33 and having a flange on the other end, sliding frame 35 integrally fixed to the latch engagement member 32 with pins 36 and to the linking bar 34, and bracing frame 37 fixed on the door 7 or on a casing of the latch unit B and stationary with respect to the sliding frame 35. The linking bar 34 extends in the latching/unlatching direction of the latch 6, and penetrates through the sliding frame 35 and the bracing frame 37. Compression spring 38 is positioned around the linking bar 34 between the bracing frame 37 and the latch-side wall of the sliding frame 35.

Figure 2:
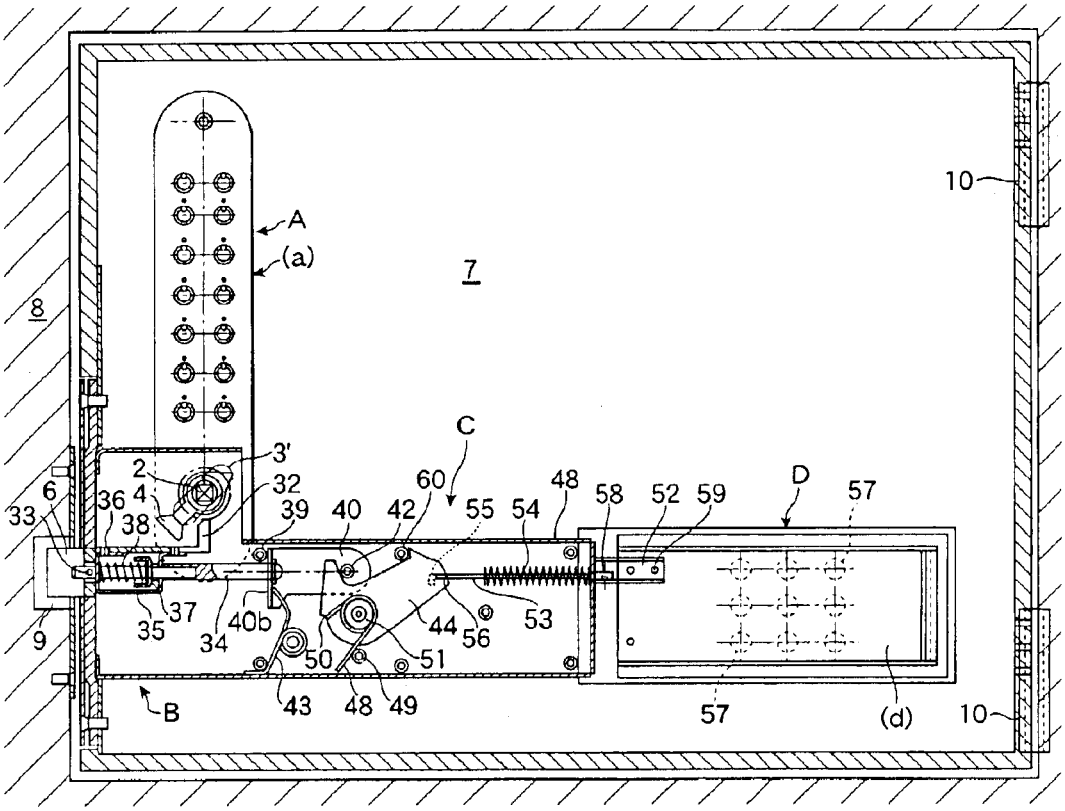
FIG. 2 is a vertical sectional view of the emergency release system for door lock of the present invention, with the door latched.
Figure 4:
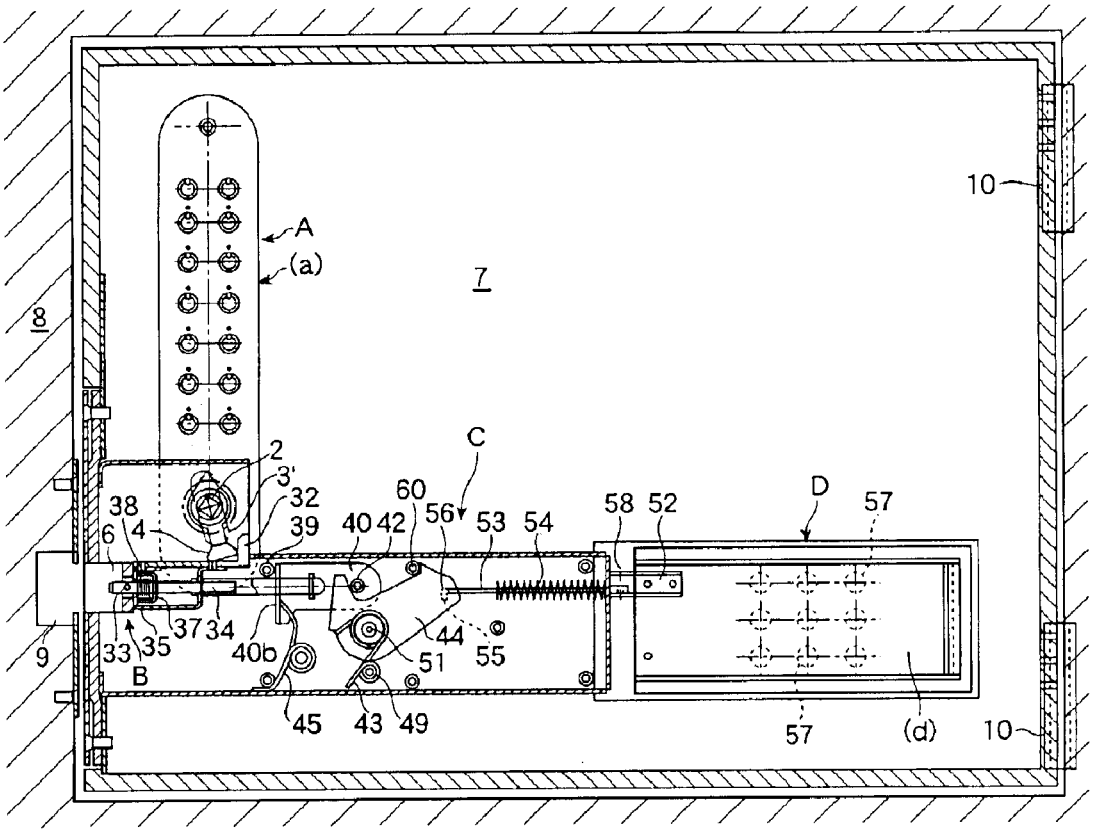
FIG. 4 is a vertical sectional view of the emergency release system for door lock of the present invention, with the door unlatched by a normal operation, and with linking unit C and sensor door unit D in their rest positions.
Figure 5:
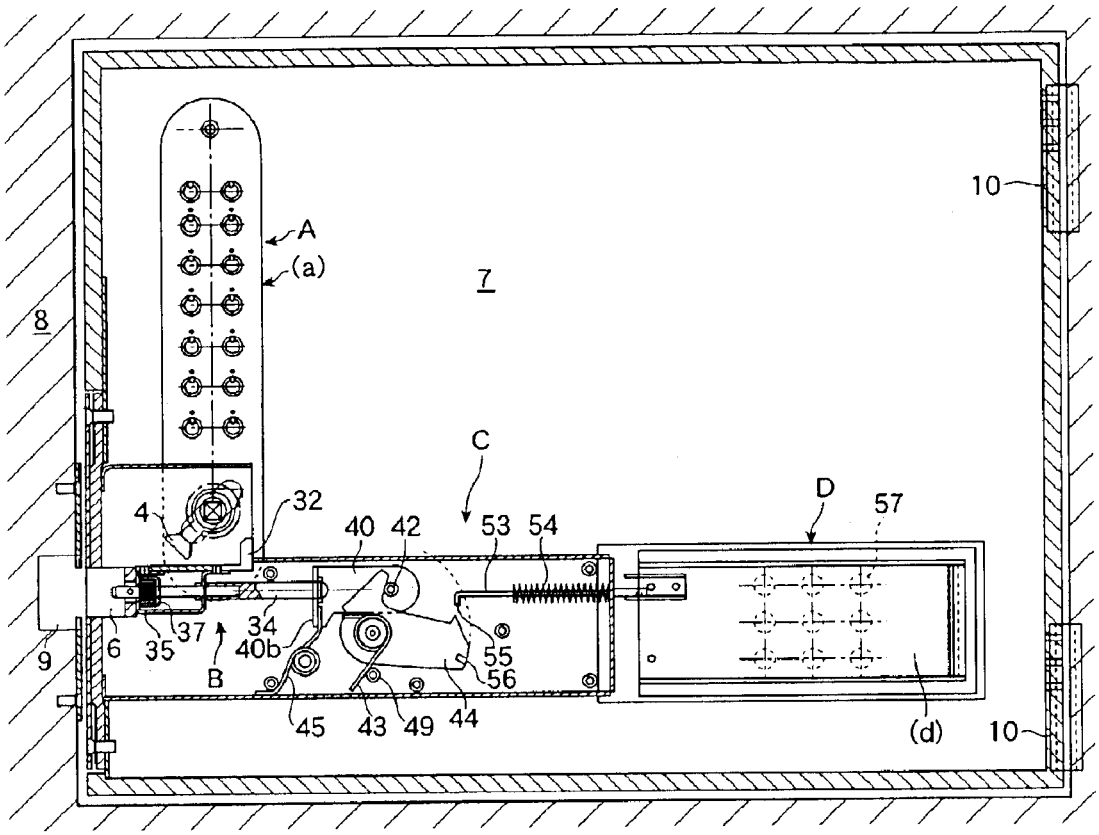
FIG. 5 is a vertical sectional view of the emergency release system for door lock of the present invention, with the door unlatched by an emergency operation.
Figure 6:
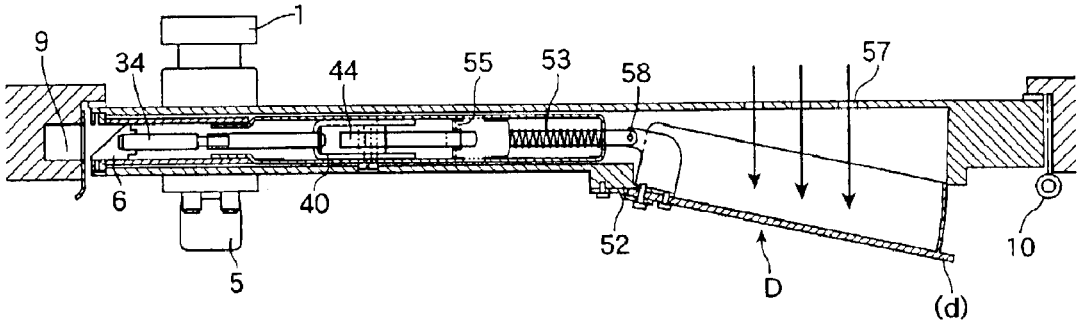
FIG. 6 is a cross sectional view taken along lines VI—VI in FIG. 5.
Figure 7:
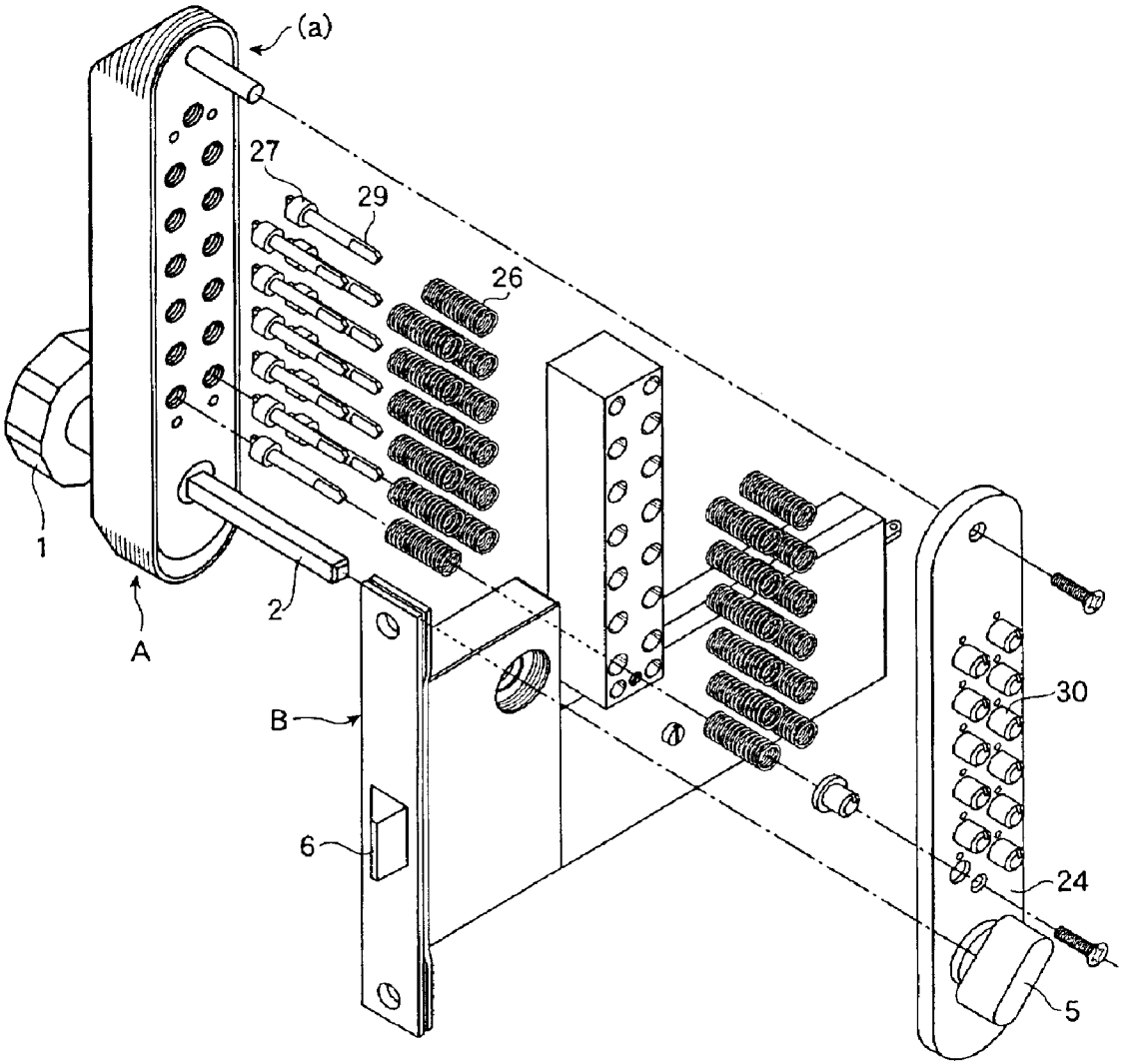
FIG. 7 is an explanatory exploded view of lock unit A of the present invention.

From the initial position shown in FIG. 2, when the latch engagement member 32 is moved in the latch releasing direction, i.e. to the right in the figure, by the release cam 4 of the lock unit A, the sliding frame 35 integrally fixed to the latch engagement member 32 moves the linking bar 34 and the latch 6 also in the latch releasing direction into the position shown in FIG. 4, against the force of the compression spring 38. When the force applied by the release cam 4 to the latch engagement member 32 is removed, the compression spring 38 urges the sliding frame 35 and thus the linking bar 34 into the latching direction, i.e. to the left in the figure, to push the latch 6 into the hole 9.

Referring to FIGS. 1, 2, 4, and 5, the linking unit C includes emergency linking member 40, cam plate 44, and engagement bar 53, all cased in casing 48.

The linking member 40 has two parallel plates 40*a* and stopper plate 40*b* connecting the parallel plates 40*a*. The stopper plate 40*b* slidably supports the free end of the linking bar 34. Catch pin 42 is fixed between the two parallel plates 40*a*. The linking member 40 is slidably supported in the casing 48 by means of guide pins 46, which are provided on the outer surface of the parallel plates 40*a*, and received and guided by slits 47 in the casing 48. The linking member 40 is urged by spring 45 toward the latch 6, i.e., to the left in FIGS. 2, 4, and 5, and is in abutment with dead bolt 39 fixed on the casing 48 or the door 7, in its rest position.

The cam plate 44 has claw 44' on one end and recess 56 on the other end, and is rotatably supported on shaft 51 fixed to the casing 48, between the two parallel plates 40*a*. Around the shaft 51 is provided spring 43, one end of which engages spring engagement portion 50 of the cam plate 44 and the other end of which is supported by pin 49 fixed to the casing 48. This spring 43 urges the cam plate 44 to rotate clockwise in FIGS. 2, 4, and 5 so that the claw 44' engages the catch pin 42 of the linking member 40. The clockwise urging force of the spring 43 is stronger than the urging force of the spring 45 applied to the linking member 40 toward the latch 6. Positioning pin 60 fixed to the casing 48 is in engagement of the cam plate 44 for limiting counterclockwise rotation of the cam plate 44 to be discussed later.

The cam plate 44 may be made of a laminate of three layers in order to improve its strength, resistance against torsion and shaking, and to prevent burr at the cutting edge during its processing.

The engagement bar 53 has two hooks 55 on one end, and is provided with compression spring 54 arranged therearound. The compression spring 54 urges the engagement bar 53 toward the cam plate 44, i.e., to the left in the figures, to securely keep the hooks 55 in engagement in the recess 56 in the cam plate 44. Here, the engagement bar 53 pushes the cam plate 44 to rotate counterclockwise, which rotation is limited by the positioning pin 60. The other end of the engagement bar 53 is connected to the sensor door unit D to be discussed below.

The sensor door unit D includes sensor door (d) and through holes 57 provided in the door 7 on the passenger cabin side at locations facing to the sensor door (d). The sensor door (d) has a scoop-like shape having a concave and side walls so as to effectively catch the air flow coming through the holes 57. One edge of the sensor door (d) is pivotally secured with hinge 52 on the door 7 on the control cabin side so that the sensor door (d) is opened into the control cabin. On the same edge side, the sensor door (d) is also connected to the free end of the engagement bar 53 of the linking unit C via a link, which is secured on one end to the sensor door (d) with screws 59 and pivotally connected to the engagement bar 53 on the other end with pin 58. In this embodiment, the door 7 is provided with nine holes 57 arranged in three lines of the holes each, but the number and arrangement of the holes may be determined as desired.

When a pressure difference above a designed threshold level occurs across the door 7, and the air pressure on the passenger cabin side becomes relatively higher, air flows through the holes 57 to hit the sensor door (d), and the sensor door (d) pivots at the hinge 52 to open into the control cabin. At the same time, the link secured to the sensor door (d) pulls the engagement bar 53 away from the latch 6.

Operation of the emergency release system for door lock is now discussed in detail.

Figure 3:
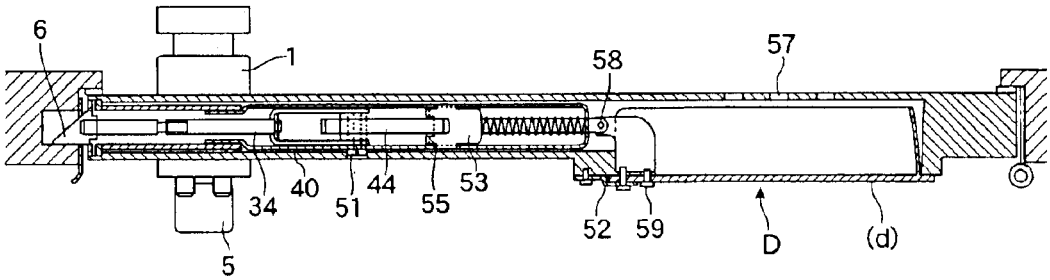
FIG. 3 is a cross sectional view taken along lines III—III in FIG. 2.

In a normal state where no abnormal air pressure difference is present across the door 7, the emergency release system is at the initial rest position as shown in FIGS. 2 and 3, with the lock (a) either set or released.

When the lock (a) is not set as shown in FIGS. 8 and 9, the door 7 is not locked and is openable either by rotating the main knob 1 on the passenger cabin side or the auxiliary knob 5 on the control cabin side. Specifically, all the lower notches 15 are in alignment with the locking plate 11, and all the positioning springs 19 are in contact with the tapered surface of the positioning plates 17. When a rotational torque is applied to the main knob 1, the knob 1, cam 3, and the release cam 4 are allowed to rotate, since the cam portion 3' is able to push the locking plate 11 upward, so that the locking plate 11 enters the lower notches 15 and the positioning springs 19 are removed from the positioning plates 17 as shown in FIG. 10. On the other hand, when a rotational torque is applied to the auxiliary knob 5, the knob 5 and the release cam 4 rotates, since the knob 5 is not associated with the lock (a). When the release cam 4 is rotated by means of either the main knob 1 or the auxiliary knob 5, the release cam 4 pushes the latch engagement member 32 in the unlatching direction as shown in FIG. 4. This also draws the latch 6 out of the hole 9 in the frame 8 into the door 7, allowing the door 7 to open. Here, the latch engagement member 32 moves the linking bar 34 and the sliding frame 35 together in the unlatching direction. However, the linking bar 34 simply slides in the stopper plate **40*b* of the emergency linking member 40, so that the linking unit C and the sensor door unit D stay in their rest positions, as shown in FIG. 4**.

For preventing unauthorized entry into the control cabin, the lock (a) is set to lock the door 7 in accordance with a desired secrete code. That is, as shown in FIGS. 12 and 13, one or more knobs 30' selected in accordance with the secrete code are turned for 180 degrees to turn the corresponding shafts 13' for 180 degrees, causing the corresponding lower notches 15' out of the alignment with the locking plate 11. In this state, when a rotational torque is applied to the main knob 1, the knob 1, cam 3, and the release cam 4 are not allowed to rotate, since, even when the cam portion 3' tries to push the locking plate 11 upward, the locking plate 11 hits the shafts 13' as shown in FIGS. 12 and 13, and cannot be moved upward. Thus the release cam 4 cannot push the latch engagement member 32, and accordingly, the door 7 cannot be opened from the passenger cabin side. On the other hand, when the auxiliary knob 5 on the control cabin side is rotated, the door 7 is opened as described above, since the knob 5 is not associated with the lock (a).

Figure 16:
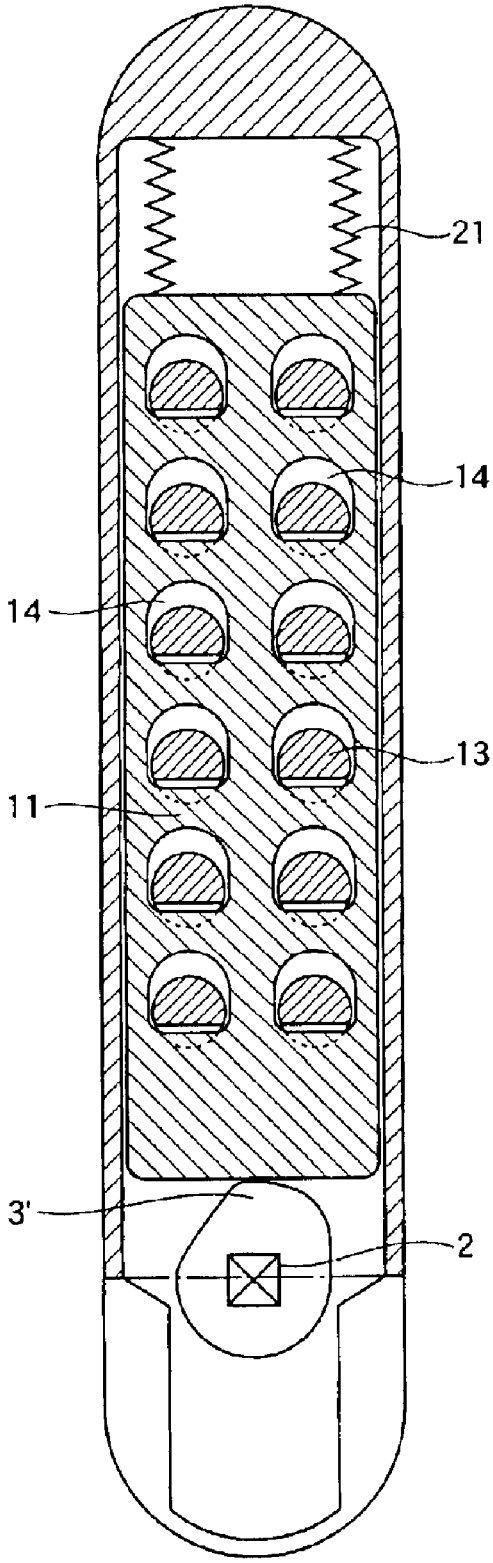
FIG. 16 is a sectional view taken along lines XVI—XVI in FIG. 15, with some parts removed for clarity.

To release the lock (a) for opening the door 7, the buttons 12' corresponding to the selected knobs 30' are pressed down to bring the corresponding upper notches 16', now oriented downward, into alignment with the locking plate 11, as shown in FIG. 14. In this state, when a rotational torque is applied to the main knob 1, the knob 1, cam 3, and the release cam 4 are allowed to rotate, since the cam portion 3' is able to push the locking plate 11 upward, so that the locking plate 11 enters the lower notches 15 and the selected upper notches 16' as shown in FIGS. 15 and 16. When the release cam 4 is rotated in this way, the door 7 is openable in the same way as discussed above.

The emergency release system functions to automatically open the door 7 when an abnormal air pressure difference occurs across the door 7. This function is explained with reference to FIGS. 5 and 6. When the air pressure in the passenger cabin suddenly becomes relatively higher than that in the control cabin by a designed threshold level, for example, due to the increase in the air pressure in the passenger cabin by explosion of a bomb, or the decrease in the air pressure in the control cabin by destruction of a window, air flows through the holes 57 in the door 7 into the sensor door (d). The air flow pushes the sensor door (d) to open into the control cabin, causing the link to pull the engagement bar 53 against the force of the compression spring 54 to the unlatching direction, i.e., to the right in the figures. Rightward movement of the engagement bar 53 disengages the hooks 55 of the bar 53 from the recess 56 in the cam plate 44, and then the cam plate 44 is allowed to rotate clockwise by the force of the spring 43. The clockwise rotation of the cam plate 44 causes the claw 44' to pull the catch pin 42 and thus the entire linking member 40 in the latch releasing direction. Then the stopper plate **40*b* of the linking member 40 pulls the linking bar 34 against the force of the spring 38, with the flange of the linking bar 34 abutting the inner surface of the stopper plate 40*b*. Accordingly, the latch 6 integrally fixed to the linking bar 34 is pulled in the latch releasing direction, and is drawn out of the hole 9 in the frame 8. Now the door 7 is unlatched, and automatically opened due to the air pressure difference, thereby balancing the air pressure across the door 7**.

For closing the door 7 opened by means of the emergency release system, the sensor door (d) is closed manually, the shaft 51 is rotated counterclockwise with a screw driver or the like tool to rotate the cam plate 44 counterclockwise into the initial position, and the hooks 55 of the engagement bar 53 are engaged in the recess 56 in the cam plate 44.

Although the present invention has been described with reference to the preferred embodiment, it should be understood that various modifications and variations can be easily made by those skilled in the art without departing from the spirit of the invention. Accordingly, the foregoing disclosure should be interpreted as illustrative only and is not to be interpreted in a limiting sense. The present invention is limited only by the scope of the following claims.

What is claimed is:

1. An emergency release for a door lock that is to be mounted to a door, said door lock comprising:

a lock unit to be mounted on the door and having a handle on each side of the door and a lock, said handle on one side of the door being associated with said lock, while said handle on the other side of the door is not associated with said lock, a latch unit having a latching bolt projectable from the door for latching the door, and retractable into the door for unlatching the door, wherein said lock, when set, prevents retraction of said latching bolt by means of rotation of said handle on the one side of the door for unlatching the door, but does not prevent retraction of said latching bolt by means of rotation of said handle on the other side of the door, a linking unit having latch retraction means connected with respect to said latch unit, and holding means for releasably holding said latch retraction means in a rest position, and a sensor unit for detecting the difference in pressure between the one side and the other side of the door and having a sensor door, wherein said sensor door is automatically opened in response to a pressure difference across the door on which the door lock is mounted above a predetermined threshold level, and is connected to said holding means to release said holding means and allow actuation of said latch retraction means when said sensor door opens, for retracting said latching bolt to allow automatic opening of the door independently of said lock unit.

2. The emergency release of the door lock of claim 1, wherein said lock is selected from the group consisting of a push button lock, dial lock, magnetic lock, and cylinder lock.

3. The emergency release of the door lock of claim 1, wherein said latch retraction means comprises a cam releasably held by said holding means, and a linking member engaging said cam and connected to said latching bolt, wherein, when said sensor door is opened, said holding means releases said cam for allowing rotation of said cam to move said linking member, and said linking member moves said latching bolt in an unlatching direction.

4. The emergency release of the door lock of claim 3, wherein said latching bolt is slidably connected to said linking member, and has engagement means for engaging said linking member so as to be moved by said linking member in an unlatching direction when said linking member is moved by said cam.

5. An emergency release system for a door lock of claim 1 wherein holes are provided in the door panel to provide connection to said sensor unit.

6. An emergency release for a door lock to be mounted to a door, said door lock comprising:

a lock unit to be mounted on the door and having a handle on each side of the door and a lock, said handle on one side of the door being associated with said lock, while said handle on the other side of the door is not associated with said lock, a latch unit having a latching bolt projectable from the door for latching the door, and retractable into the door for unlatching the door, wherein said lock, when set, prevents retraction of said latching bolt by means of rotation of said handle on the one side of the door for unlatching the door, but does not prevent retraction of said latching bolt by means of rotation of said handle on the other side of the door, a linking unit having latch retraction means connected with respect to said latch unit, and holding means for releasably holding said latch retraction means in a rest position, and a sensor door unit to be provided in the door and having a sensor door, wherein said sensor door is automatically opened in response to a pressure difference across the door above a predetermined threshold level, and is connected to said holding means so that said holding means releases and allows actuation of said latch retraction means when said sensor door is opened, for retracting said latching bolt to allow automatic opening of the door independently from said lock unit, wherein said lock unit further comprises a release cam actuated by means of said handles, wherein said latch unit further comprises:

a latch engagement member connected to said latching bolt, a sliding frame connected to said latching bolt, a bracing frame stationary with respect to said sliding frame, said latching bolt penetrating said sliding frame and said bracing frame, and a spring positioned around the latching bolt between said sliding frame and said bracing frame for urging said sliding frame and thus the latching bolt in a latching direction, wherein said latch engagement member and said release cam cooperate to retract said latching bolt to unlatch the door against a force of said spring, when either of said handles is rotated.

7. An emergency release for a door lock to be mounted on a door, said door lock comprising:

a lock unit to be mounted on the door and having a handle on each side of said door and a lock, said handle on one side of the door being associated with said lock, while said handle on the other side of the door is not associated with said lock, a latch unit having a latching bolt projectable from the door for latching the door, and retractable into the door for unlatching the door, wherein said lock, when set, prevents retraction of said latching bolt by means of rotation of said handle on the one side of the door for unlatching the door, but does not prevent retraction of said latching bolt by means of rotation of said handle on the other side of the door, a linking unit having latch retraction means connected with respect to said latch unit and holding means for releasably holding said latch retraction means in a rest position, and a sensor door unit to be provided in the door and having a sensor door, wherein said sensor door is automatically opened in response to a pressure difference across the door above a predetermined threshold level, and is connected to said holding means so that said holding means releases and allows actuation of said latch retraction means when said sensor door is opened, for retracting said latching bolt to allow automatic opening of the door independently from said lock unit, wherein said sensor door unit further comprises a plurality of through holes to be provided in the door on which the door lock is mounted, and wherein said sensor door has a concave, said through holes to be positioned facing to said concave.

8. An emergency release for a door lock to be mounted on a door, said door lock comprising:

a lock unit to be mounted on the door and having a handle on each side of the door and a lock, said handle on one side of the door being associated with said lock, while said handle on the other side of the door is not associated with said lock, a latch unit having a latching bolt projectable from the door for latching the door, and retractable into the door for unlatching the door, wherein said lock, when set, prevents retraction of said latching bolt by means of rotation of said handle on the one side of the door for unlatching the door, but does not prevent retraction of said latching bolt by means of rotation of said handle on the other side of the door, a linking unit having latch retraction means connected with respect to said latch unit, and holding means for releasably holding said latch retraction means in a rest position, and a sensor door unit to be provided in the door and having a sensor door, wherein said sensor door is automatically opened in response to a pressure difference across the door above a predetermined threshold level, and is connected to said holding means so that said holding means releases and allows actuation of said latch retraction means when said sensor door is opened, for retracting said latching bolt to allow automatic opening of the door independently from said lock unit, wherein said latching bolt is slidably connected to said latch retraction means, and when said latching bolt is retracted by means of one of said handles, the latching bolt slides with respect to said latch retraction means, with said latch retraction means remaining in said rest position.

* * * * *